US005317343A

United States Patent [19]

Brock et al.

[11] Patent Number: 5,317,343

[45] Date of Patent: May 31, 1994

[54] ELECTRODES FOR RESISTIVE RIBBON THERMAL PRINT HEAD

[75] Inventors: George W. Brock, La Jolla, Calif.; Michael E. Long, Penfield, N.Y.

[73] Assignee: Eastman Kodak Company, Rochester, N.Y.

[21] Appl. No.: 947,588

[22] Filed: Sep. 21, 1992

[51] Int. Cl.[5] ..... B41J 2/385

[52] U.S. Cl. ..... 346/76 PH

[58] Field of Search ..... 346/76 PH, 139 C; 366/155; 400/120

[56] References Cited

U.S. PATENT DOCUMENTS 4,621,271 11/1986 Brownstein ..... 346/76 PH 5,059,985 10/1991 Takeuchi et al. ..... 346/76 PH

FOREIGN PATENT DOCUMENTS 0066938 3/1987 Japan ..... 346/76 PH 0099163 5/1987 Japan ..... 346/76 PH

OTHER PUBLICATIONS

"Hard Coating For Printing Heads", IBM Bulletin vol. 30, No. 4, Sep. 1987 p. 1719.

*Primary Examiner*—Benjamin R. Fuller

*Assistant Examiner*—Huan Tran

*Attorney, Agent, or Firm*—Raymond L. Owens

[57] ABSTRACT

A print head for a resistive ribbon thermal printer has the electrodes made of WC, $W_2C$, $Ti_2N$, TiC, TaC, $TaSi_2$, $MoSi_2$ or ZrC.

22 Claims, 2 Drawing Sheets

FIG. 1
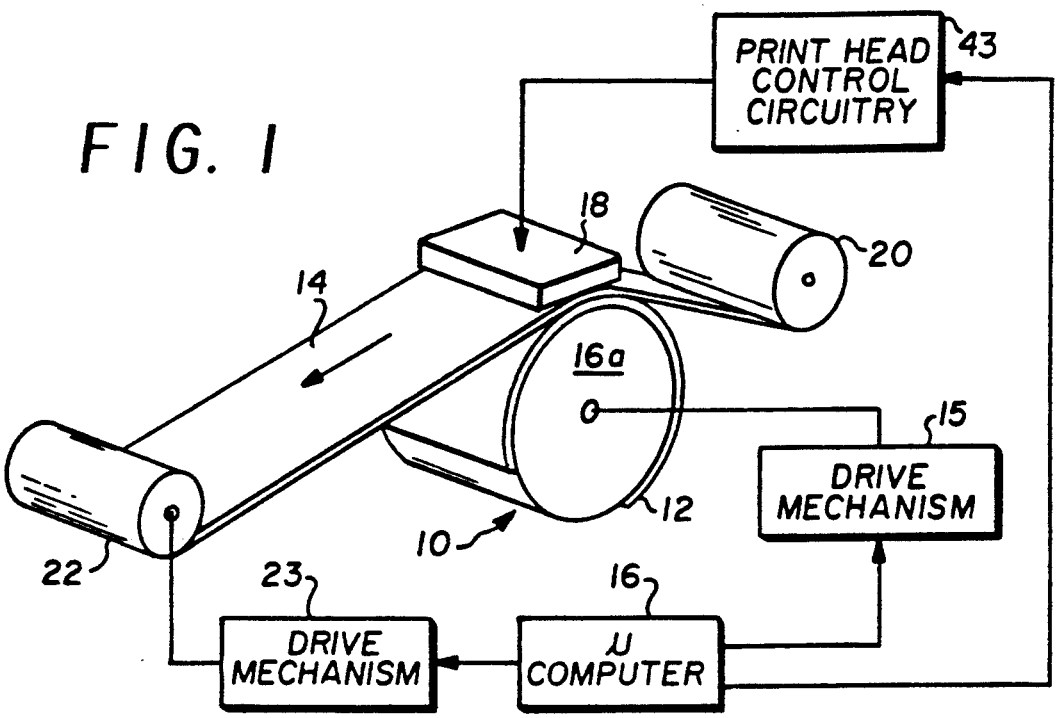
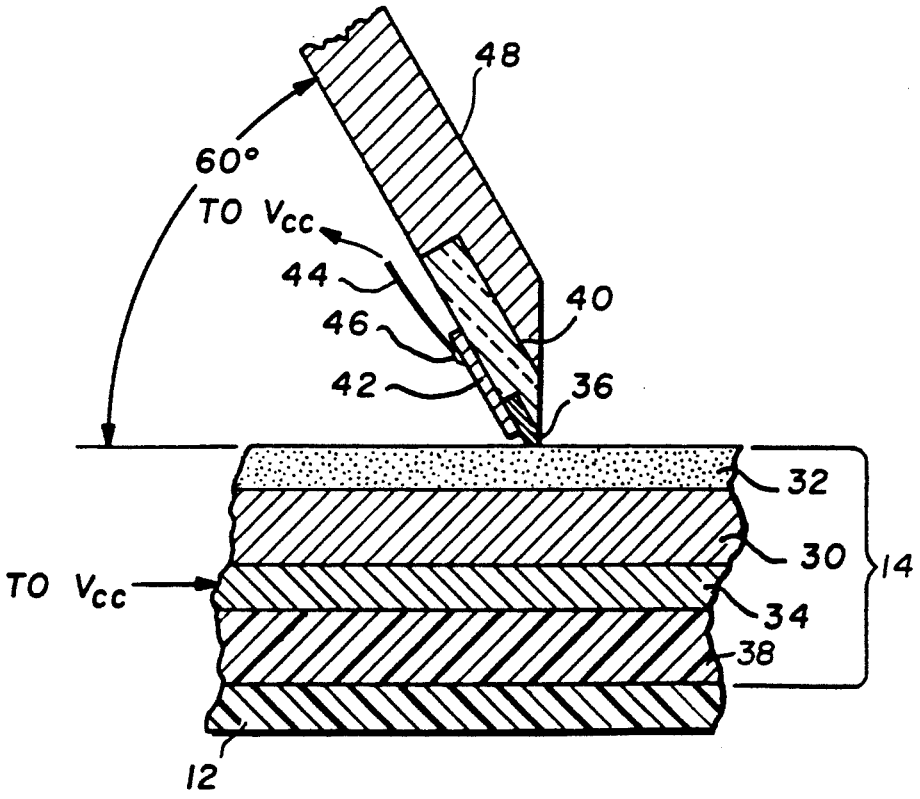
FIG. 2

ELECTRODES FOR RESISTIVE RIBBON THERMAL PRINT HEAD

FIELD OF THE INVENTION

The present invention relates to resistive ribbon thermal printer heads, and more particularly, to the electrodes for such print heads.

BACKGROUND OF THE INVENTION

In one type of thermal printer which prints colored images, a carrier contains a repeating series of spaced frames of different colored heat transferable dyes. In such apparatus, the carrier is disposed between a receiver, such as coated paper, and a print head formed of, for example, a plurality of individual heating elements. When a particular heating element is energized, it is heated and causes dye from the carrier to transfer to the receiver. The density or darkness of the printed color dye is a function of the energy delivered from the heating element to the carrier.

Thermal dye transfer printers offer the advantage of true "continuous tone" dye density transfer. This result is obtained by varying the energy applied to each heating element, yielding a variable dye density image pixel on the receiver.

One type of thermal printer uses resistive ribbons. In U.S. Pat. No. 4,434,356 assigned to the IBM Corporation, a circuit is described which provides constant current to a resistive ribbon carrier. Resistive ribbon printing technology uses a carrier which includes a metal conducting layer and a dye layer containing a dye to be transferred to a receiver. Current is supplied to the carrier by an electrode or array of electrodes and returns to ground via the conductive layer. The electric current is converted to heat through the resistive heating of the carrier. The heat causes dye to transfer to a receiver.

In the print head for such printers, a plurality of spaced conductive electrodes are secured to a substrate such as shown in U.S. Pat. No. 4,684,960. A problem with the electrodes is that they frequently wear unevenly and consequently make poor electrical connection to the carrier. Hardness of the low electrical resistivity electrodes has been shown to be an important consideration for wear resistance, and metals of high hardness such as molybdenum and tungsten, are preferred. However, these probe materials have to be refurbished at intervals by abrasively polishing the probes provide for proper contact with the carrier.

With faster printing speeds and higher temperatures at the probe interface, the uneven wear of the electrodes becomes a functional constraint and a low electrical resistivity probe material of higher hardness and wear resistance is required, to reduce or eliminate the need for frequent refurbishing of the electrode.

After a number of prints have been made, the surfaces of the substrate and electrodes which contact the carrier must be ground smooth by an abrasion wheel made of diamond, silicon carbide, aluminum oxide or the like.

SUMMARY OF THE INVENTION

Accordingly, it is an object of this invention to provide an improved print head which has wear resistant conductive electrodes which minimize or obviate the need for grinding.

This object is achieved in a resistive ribbon print head for delivering current to a dye carrier ribbon comprising:

(a) a non-electrically conductive ceramic substrate; and (b) a plurality of spaced electrical conductive electrodes secured to the substrate, a surface of each probe being adapted to contact a dye carrier and wherein the electrode is formed from WC, $W_2C$, $Ti_2N$, TiC, TaC, $TaSi_2$, $MoSi_2$ or ZrC.

A feature of this invention is that the electrodes can be made of the non-oxide, electrically conductive materials set forth above. These materials are not only good electrical conductors but have a hardness which will prevent wear.

BRIEF DESCRIPTION OF DRAWINGS

FIG. 1 is a schematic of a resistive ribbon thermal printer apparatus which can be employed to make colored image in a receiver in accordance with the invention;

FIG. 2 shows a cross-section of a typical resistive ribbon carrier and a print head in accordance with the invention which is used by the apparatus shown in FIG. 1.

DESCRIPTION OF THE PREFERRED EMBODIMENT

Figure 3:
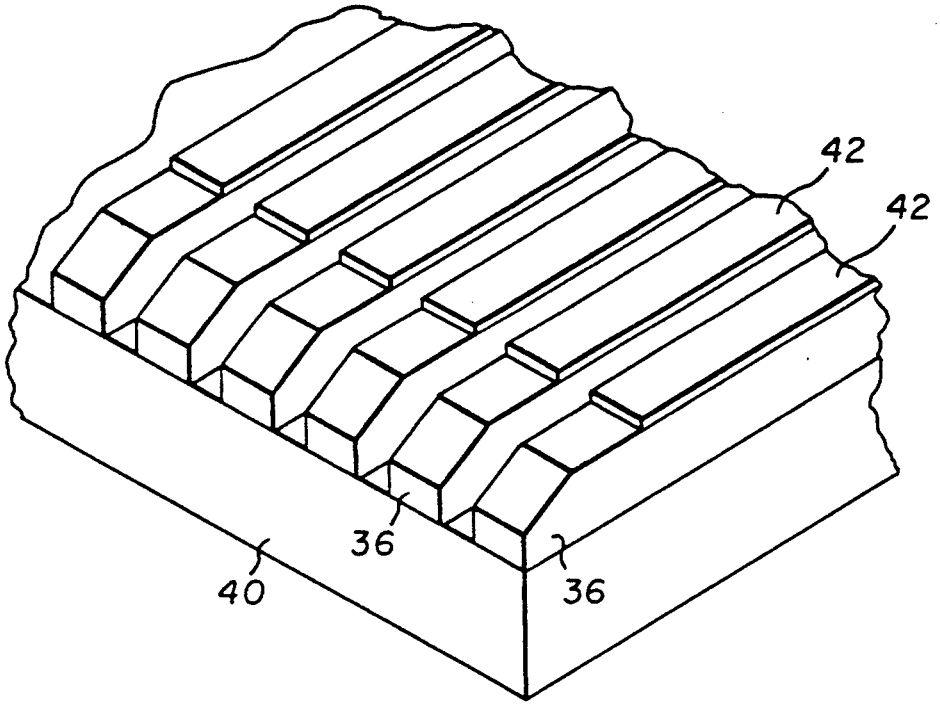
FIG. 3 is a schematic of the print head of FIG. 2.

To facilitate an understanding of the present invention, reference is first made to FIG. 1 which shows a typical section of a resistive ribbon carrier 14 which may be used in the thermal printer 10 shown in FIG. 1. The carrier 14 comprises a strip having a clear leader portion followed by a repeating series of conventional colored dye frames (not shown). The dye frames are spaced and each series includes in sequence yellow, magenta and cyan dye frames. A black frame can also be used.

FIG. 2 shows a cross-section of the resistive ribbon carrier 14. The carrier 14 includes a support 30 which can be made of a mixture of carbon and polycarbonate. On one surface of the support is an optional interface layer 32, which bears against a surface of each electrode of a print head 18 in the printer 10 of FIG. 1. On the other surface of the support 30 is a conductive layer 34 which can be made of aluminum and aluminum oxide as described in the prior art. A current pulse from the electrode 36 passes through the interface 32, support 30 and conductive layer 34 and returns to a current source $V_{cc}$ (not shown) via the conductive layer 34. In this process, heat is generated and transferred to a dye layer 38. Dye is transferred from the dye layer 38 to a receiver member 12. A slipping layer (not shown) can be provided on the dye layer 38.

Referring again to FIG. 1, the receiver member 12, in the form of a sheet, is secured to a rotatable drum **16*a* which is mechanically coupled to a drive mechanism 15. It will be understood that the drive mechanism 15 continuously advances the drum 16*a* and receiver sheet 12 along a path past the stationary print head 18 during a cycle for energizing electrodes 36 of the print head. The print head 18 has a plurality of such electrodes 36 which have a surface that contacts the carrier. Only one electrode 36** is shown in FIG. 2 and six in FIG. 3.

The receiver 12 can be uncoated paper. Uncoated paper usually contains not more than 10% mechanical (groundwood) fiber with the remainder of the fiber being chemical wood pulps (either wood pulp or secondary fiber). Alternatively, the paper may be coated with a resin layer that is a good dye absorber capable of providing effective color printing.

In FIG. 2, a surface of each electrode 36 presses against the interface layer 32 of the carrier member 14 and forces the carrier member against the receiver member 12. As shown in FIG. 1, the carrier member 14 is driven along a path from a supply roller 20 onto a take-up roller 22 by a drive mechanism 23 coupled to the take-up roller 22. The drive mechanisms 15 and 23 each include motors which respectively continuously advance the carrier and the receiver relative to the electrodes of the print head as the electrodes are selectively energized with constant current pulse.

The microcomputer 16 controls the timing of the energization of each electrode. During printing, as the members 12 and 14 are moved, dye image pixels are formed in the receiver member 12. As noted above, these members are moved continuously along paths relative to the print head 18 during operation of the mechanisms 15 and 23.

The carrier member 14 is formed with a repeating series of thermally transferably for example (sublimable) dye frames. Each series may include frames of yellow, magenta and cyan dye frames. The sequence of yellow, magenta and cyan is repeated. A single series of frames is used to print one colored image in the receiver member 12. In the preferred embodiment, the sublimable dye is a material in which the amount of dye which transfers from the carrier to a receiver is in response to the heat level produced by the flow of current applied by the individual electrodes of the print head 18.

Any dye can be used in the dye layer provided it is transferable to the dye image-receiving layer of the dye-receiving element of the invention by the action of heat. Especially good results have been obtained with sublimable dyes. Examples of sublimable dyes include anthraquinone dyes, e.g. Sumikalon Violet RS ® (product of Sumitomo Chemical Co., Ltd.) Dianix Fast Violet 3R-FS ® (product of Mitsubishi Chemical Industries Ltd.), and Kayalon Polyol Brilliant Blue N-BGM ® and KST Black 146 ® (products of Nippon Kayaku Co., Ltd.), azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.) and Miktazol Black 5GH ® (product of Mitsui Toatsu Chemicals, Inc.), direct dyes such as Direct Dark Green B ® (product of Mitsubishi Chemical Industries, Ltd.) and direct Brown M ® and direct Fast Black D ® (products of Nippon Kayaku Co., Ltd.); acid dyes such as Kayanol Milling Cyanine 5 ® (product of Nippon Kayaku Col., Ltd.); basic dyes such as Sumiacryl Blue 6G ® (produce of Sumitomo Chemical Co., Ltd.), and Aizen Malachite Green ® (product of Hodogaya Chemical Co., Ltd); or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

Turning now to FIGS. 2 and 3, the print head 18 includes a plurality of spaced electrically conductive electrodes 36 which are secured on a nonelectrically conductive ceramic substrate 40 which can be made of magnesium oxide, aluminum nitride, aluminum oxide or combinations thereof. In the interstices between electrodes 36, $Al_2O_3$, $SiO_2$ can be provided to prevent short circuiting. As best seen in FIG. 2, a free surface of each electrode 36 is adapted to contact the interface layer 32 of the carrier 14. Also, on the top surface of each electrode 36, shown in plurality in FIG. 3 and singularly in FIG. 2, is a conductor layer 42, which in turn is attached to interconnect 44 via bond pad 46. The interconnects 44 then complete the circuit by eventual connection to current supply $V_{cc}$ (not shown) which is included in the print head control circuitry 43 of FIG. 1. The above described unit is attached to structural support 48 (see FIG. 2) which can be made of any material of structural rigidity such as metal (aluminum, steel, brass, copper) or plastic (polycarbonate, etc.).

The electrodes 36 in accordance with this invention are formed from a non-oxide, electrically conductive ceramic such as tunsten carbide (WC, $W_2C$) titanium carbide (TiC), titanium nitride ($Ti_2N$), tantalum carbide (TaC) tantalum silicide, ($TaSi_2$), molybdenum silicide ($MoSi_2$) or zirconium carbide (ZrC). the substrate 40 consists of a ceramic of lower hardness and wear resistance than the electrode material, such that the probes do not wear preferentially to the substrate and thus lose contact with the ribbon surface. The substrate can consist of such electrically insulative materials as aluminum oxide, aluminum nitride, magnesium oxide, barium titanate, or combinations thereof such as $MgO.SiO_2$ (steatite) and $MgO.SiO_2.Al_2O_3$ (cordierite). The choice of substrate depends on the degree of wear resistance required, relative to the electrode and its thermal conductivity. For low print speeds, a poor thermal conductor is preferred, as this pulls less heat from the printing ribbon, and consequently is a more thermally efficient print head. For high printing speeds, heat needs to be conducted away from the ribbon probe interface, otherwise ribbon damage occurs and, consequently, a higher thermally conductive substrate is required.

A comparison of the hardness range of the non-oxide ceramic electrodes with molybdenum and tungsten metal electrodes is shown below:

| | |
|---|---|
| Molybdenum | $V_H$250 Kg/mm$^2$ |
| Tungsten | $V_H$480 Kg/mm$^2$ |
| *Titanium Carbide | $V_H$2200 Kg/mm$^2$ |
| *Tantalum Carbide | $V_H$1700 Kg/mm$^2$ |
| *Titanium Nitride | $V_H$2500 Kg/mm$^2$ |
| *Tungsten Carbide | $V_H$2200 Kg/mm$^2$ |

*Suitable as an electrode

Other suitable non-oxide electrically conductive ceramics which can be used as electrodes are $TaSi_2$, $MoSi_2$, and ZrC.

The invention has been described in detail with particular reference to a certain preferred embodiment thereof, but it will be understood that variations and modifications can be effected within the spirit and scope of the invention.

We claim:

1. A resistive ribbon pringt head for delivering electrical current to a dye carrier resistive ribbon, the resistive ribbon print head comprising:

(a) a non-electrically but thermally conductive ceramic substrate; and (b) a plurality of spaced electrically conductive non-oxide ceramic electrodes secured to the substrate, each of said electrodes (i) being formed throughout from material WC, $W_2C$, TaC, or ZrC, and (ii) having a free surface of said material adapted to contact a dye carrier resistive ribbon.

2. The print head of claim 1 wherein the substrate is a non-electrically conductive ceramic having a lower hardness and wear resistance than the electrodes.

3. The pringt head of claim 2 wherein the spaced electrodes define interstices therebetween, and $Al_2O_3$ or $SiO_2$ is provided in the interstices to prevent short circuiting between the electrodes.

4. A resistive ribbon print head for delivering electrical current to a dye carrier resistive ribbon, the resistive ribbon print head comprising:

(a) a non-electrically but thermally conductive ceramic substrate; and (b) a plurality of spaced electrically conductive non-oxide ceramic electrodes secured to the substrate, each of said electrodes (i) being formed throughout from material $TaSi_2$ or $MoSi_2$, and (ii) having a free surface of said material adapted to contact a dye carrier resistive ribbon.

5. The print head of claim 4 wherein the substrate is a nonelectrically conductive ceramic having a lower hardness and wear resistance than the electrodes.

6. The print head of claim 5 wherein the spaced electrodes define interstices therebetween, and $Al_2O_3$ or $SiO_2$ is provided in the interstices to prevent short circuiting between the electrodes.

7. A resistive ribbon print head for delivering electrical current to a dye carrier resistive ribbon, the resistive ribbon print head comprising:

(a) a non-electrically but thermally conductive ceramic substrate; and (b) a plurality of spaced electrically conductive non-oxide ceramic electrodes secured to the substrate, each of said electrodes (i) being formed throughout from material $Ti_2N$ or TiC, and (ii) having a free surface of said material adapted to contact a dye carrier resistive ribbon.

8. The print head of claim 7 wherein the substrate is a nonelectrically conductive ceramic having a lower hardness and wear resistance than the electrodes.

9. The print head of claim 8 wherein the spaced electrodes define interstices therebetween, and $Al_2O_3$ or $SiO_2$ is provided in the interstices to prevent short circuiting between the electrodes.

10. A resistive ribbon thermal printer apparatus for forming dye images on a receiver, the resistive ribbon thermal printer apparatus comprising:

a source of electrical energy;

a dye carrier resistive ribbon including a carrier support having a first side and an opposed second side provided with a conductive layer, and a dye layer of heat transferable dye disposed on the conductive layer; and a resistive ribbon print head for delivering electrical energy from said source to said ribbon, said print head including a non-electrically but thermally conductive ceramic substrate and a plurality of spaced electrically conductive non-oxide ceramic electrodes secured to the substrate, each of said electrodes (i) being formed throughout from material $TaSi_2$ or $MoSi_2$, (ii) being arranged for receiving electrical energy from said source, and (iii) having a free surface of said material arranged for electrical contact with the first side of said ribbon to deliver electrical energy by way of said free surface through the first side and carrier support of said ribbon to the conductive layer to what the dye in said dye layer.

11. The apparatus of claim 10 wherein the substrate is a non-electrically conductive ceramic having a lower hardness and wear resistance than the electrodes.

12. The apparatus of claim 11 wherein the spaced electrodes define interstices therebetween, and $Al_2O_3$ or $SiO_2$ is provided in the interstices to prevent short circuiting between the electrodes.

13. The apparatus of claim 10 wherein said heat transferable dye is sublimable dye.

14. A resistive ribbon thermal printer apparatus for forming dye images on a receiver, the resistive ribbon thermal printer apparatus comprising:

a source of electrical energy;

a dye carrier resistive ribbon including a carrier support having a first side and an opposed second side provided with a conductive layer, and a dye layer of heat transferable dye disposed on the conductive layer; and a resistive ribbon print head for delivering electrical energy from said source to said ribbon, said print head including a non-electrically but thermally conductive ceramic substrate and a plurality of spaced electrically conductive non-oxide ceramic electrodes secured to the substrate, each of said electrodes (i) being formed throughout from material $Ti_2N$ or TiC, (ii) being arranged for receiving electrical energy from said source, and (iii) having a free surface of said material arranged for electrical contact with the first side of said ribbon to deliver electrical energy by way of said free surface through the first side and carrier support of said ribbon to the conductive layer to heat the dye in said dye layer.

15. The apparatus of claim 14 wherein the substrate is a non-electrically conductive ceramic having a lower hardness and wear resistance than the electrodes.

16. The apparatus of claim 15 wherein the spaced electrodes define interstices therebetween, and $Al_2O_3$ or $SiO_2$ is provided in the interstices to prevent short circuiting between the electrodes.

17. The apparatus of claim 14 wherein said heat transferable dye is sublimable dye.

18. A resistive ribbon thermal printer apparatus for forming dye images on a receiver, the resistive ribbon thermal printer apparatus comprising:

a source of electrical energy;

a dye carrier resistive ribbon including a carrier support having a first side and an opposed second side provided with a conductive layer, and a dye layer of heat transferable dye disposed on the conductive layer; and a resistive ribbon print head for delivering electrical energy from said source to said ribbon, said print head including a non-electrically but thermally conductive ceramic substrate and a plurality of spaced electrically conductive non-oxide ceramic electrodes secured to the substrate, each of said electrodes (i) being formed through from material WC, $W_2C$, TaC or ZrC, (ii) being arranged for receiving electrical energy from said source, and (iii) having a free surface of said material arranged for electrical contact with the first side of said ribbon to deliver electrical energy by way of said free surface through the first side and carrier support of said ribbon to the conductive layer to heat the dye in said dye layer.

19. The apparatus of claim 18 wherein the substrate is a non-electrically conductive ceramic having a lower hardness and wear resistance than the electrodes.

20. The apparatus of claim 19 wherein the spaced electrodes define interstices therebetween, and $Al_2O_3$ or $SiO_2$ is provided in the interstices to prevent short circuiting between the electrodes.

21. The apparatus of claim 18 wherein said heat transferable dye is sublimable dye.

22. A resistive ribbon print head for delivering electrical current to a dye carrier resistive ribbon, said resistive ribbon print head comprising a plurality of spaced electrically conductive non-oxide ceramic electrodes, each of said electrodes (i) being formed throughout from material WC, $W_2C$, TaC, or ZrC, and (ii) having a free surface of said material adapted to contact said ribbon.

* * * * *

UNITED STATES PATENT AND TRADEMARK OFFICE

CERTIFICATE OF CORRECTION

PATENT NO. : 5,317,343

DATED : May 31, 1994

INVENTOR(S) : George W. Brock, et. al.

It is certified that error appears in the above-indentified patent and that said Letters Patent is hereby corrected as shown below:

Col. 4, Claim 1, line 61, delete "pringt" and insert --print--.
Col. 5, Claim 3, line 7, delete "pringt" and insert print--.
Col. 5, Claim 5, line 23, delete "nonelectrically" and insert --non-electrically--.
Col. 6, Claim 18, line 60, delete "through" and insert--throughout--.

Signed and Sealed this

Eleventh Day of October, 1994

*Attest:*

Bruce Lehman

BRUCE LEHMAN

*Attesting Officer*

*Commissioner of Patents and Trademarks*